US005706986A

United States Patent [19]

Brandenburg et al.

[11] Patent Number: 5,706,986

[45] Date of Patent: Jan. 13, 1998

[54] WATER-SHEDDING WASHROOM DISPENSER

[75] Inventors: Allen E. Brandenburg, Austin; John Maldonado, San Antonio, both of Tex.

[73] Assignee: Kimberly-Clark Corporation, Neenah, Wis.

[21] Appl. No.: 556,493

[22] Filed: Nov. 13, 1995

[51] Int. Cl.[6] ..... A47B 81/00

[52] U.S. Cl. ..... 222/192; 242/597.8; 312/229

[58] Field of Search ..... 222/192, 183; 221/86, 282, 286; 242/590, 596.8, 598.6, 597.8; 312/229, 100, 34.8; 225/40; 83/649, 650

[56] References Cited

U.S. PATENT DOCUMENTS

| | | | |
|---|---|---|---|
| 3,363,953 | 1/1968 | Lacan | 312/229 X |
| 3,479,104 | 11/1969 | Kobryner | 312/229 |
| 3,672,552 | 6/1972 | Krueger et al. | 226/129 |
| 5,048,386 | 9/1991 | DeLuca et al. | 83/649 X |
| 5,273,184 | 12/1993 | Rizzuto | 221/303 |

FOREIGN PATENT DOCUMENTS

| | | |
|---|---|---|
| 929140 | 6/1973 | Canada . |
| 91 13 931 | 1/1992 | Germany . |
| 618 084 | 7/1980 | Switzerland . |

*Primary Examiner*—Kevin P. Shaver
*Attorney, Agent, or Firm*—Karl V. Sidor

[57] ABSTRACT

A combined paper towel and hand soap dispenser for a public washroom includes a base that is adapted to be mounted to a surface in a public washroom, a paper towel dispensing mechanism, a hand soap dispensing mechanism, and a cover that is mounted to the base. The cover defines an interior space in which the paper towel dispensing mechanism and the hand soap dispensing mechanisms are positioned. The cover is mounted to the base so as to be movable between an open position for refilling the system with hygienic product and a closed, operative dispensing position. Water channeling structure is positioned between the base and the cover to channel water that may fall between the cover and the base away from the interior space. As a result, the dispensing mechanisms and any product therein will be prevented from getting wet during custodial cleaning.

13 Claims, 3 Drawing Sheets

WATER-SHEDDING WASHROOM DISPENSER

BACKGROUND OF THE INVENTION

1. Field of the Invention

This invention relates broadly to the field of dispensers for dispensing personal hygiene products, such as paper towels, toilet tissue and hand soap, in a public washroom. More specifically, this invention relates to a dispenser that is specifically designed to avoid water penetration and ensuing product and mechanism damage during custodial cleaning.

2. Description of the Prior Art

Dispensers for such items as paper towels, toilet paper, hand soap and sanitary napkins are common in public washrooms throughout the world. To maintain sanitary conditions and a general impression of cleanliness in such facilities, dispensers must be wiped down or washed on a frequent basis along with other surfaces of the washroom, such as the walls, commodes and mirrors.

Conventional dispensers are best cleaned with a slightly damp cloth or paper towel, then wiped dry. If the towel is too wet, or if water is poured or sprayed directly over the dispenser, it can seep or flow into the interior of the dispenser, corroding the mechanism inside and damaging the product that is being dispensed. This is particularly a problem when the product is made to absorb water, such as paper towels or toilet paper. Unfortunately, there is no practical way of ensuring under actual conditions that custodial personnel do not use too much water or cleaning solution.

A need exists for an improved dispensing mechanism for public washrooms that is less susceptible to water penetration and damage than conventional dispensers are.

SUMMARY OF THE INVENTION

Accordingly, it is an object of the invention to provide an improved dispensing mechanism for public washrooms that is less susceptible to water penetration and damage than conventional dispensers are.

In order to achieve the above and other objects of the invention, a system for dispensing a hygienic product in a public washroom includes a base that is adapted to be mounted to a surface in a public washroom; a dispensing mechanism; a cover that is mounted to the base, the cover defining an interior space in which the dispensing mechanism is positioned, the cover being mounted to the base so as to be movable between an open position for refilling the system with hygienic product and a closed, operative dispensing position; and water channeling structure positioned between the base and the cover to channel water that may fall between the cover and the base away from the interior space, whereby the dispensing mechanism and any product therein will be prevented from getting wet during custodial cleaning.

According to a second aspect of the invention, a combined paper towel and hand soap dispenser for a public washroom includes a base that is adapted to be mounted to a surface in a public washroom; a paper towel dispensing mechanism; a hand soap dispensing mechanism; a cover that is mounted to the base of the cover defining an interior space in which the paper towel dispensing mechanism and the hand soap dispensing mechanisms are positioned, the cover being mounted to the base so as to be movable between an open position for refilling the system with hygienic product and a closed, operative dispensing position; and water channeling structure positioned between the base and the cover to channel water that may fall between the cover and the base away from the interior space, whereby the dispensing mechanisms and any product therein will be prevented from getting wet during custodial cleaning.

These and various other advantages and features of novelty which characterize the invention are pointed out with particularity in the claims annexed hereto and forming a part hereof. However, for a better understanding of the invention, its advantages, and the objects obtained by its use, reference should be made to the drawings which form a further part hereof, and to the accompanying descriptive matter, in which there is illustrated and described a preferred embodiment of the invention.

DETAILED DESCRIPTION OF THE PREFERRED EMBODIMENT(S)

Figure 1:
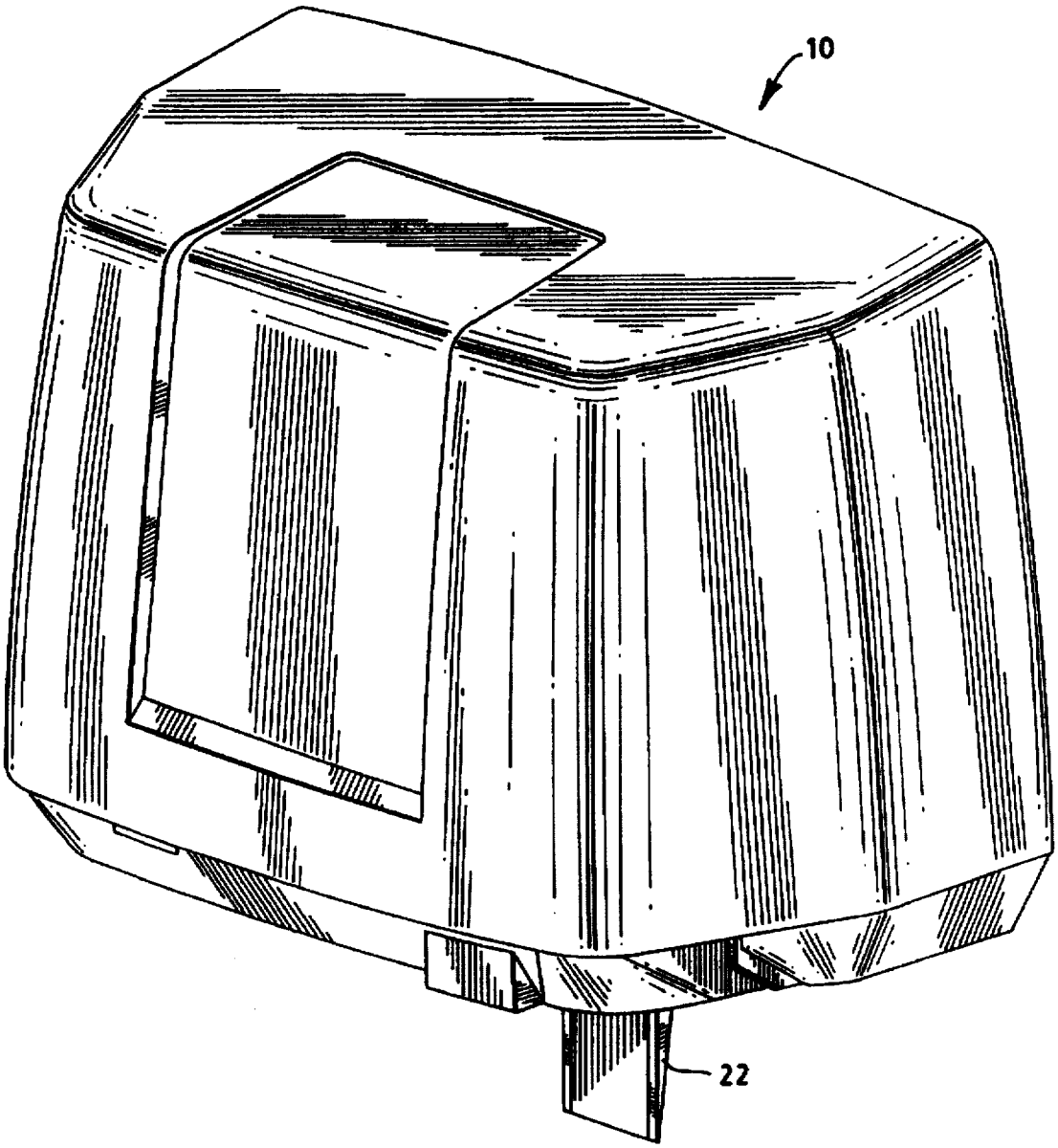
FIG. 1 is a perspective view of a system for dispensing a hygienic product that is constructed according to a first preferred embodiment of the invention.
Figure 2:
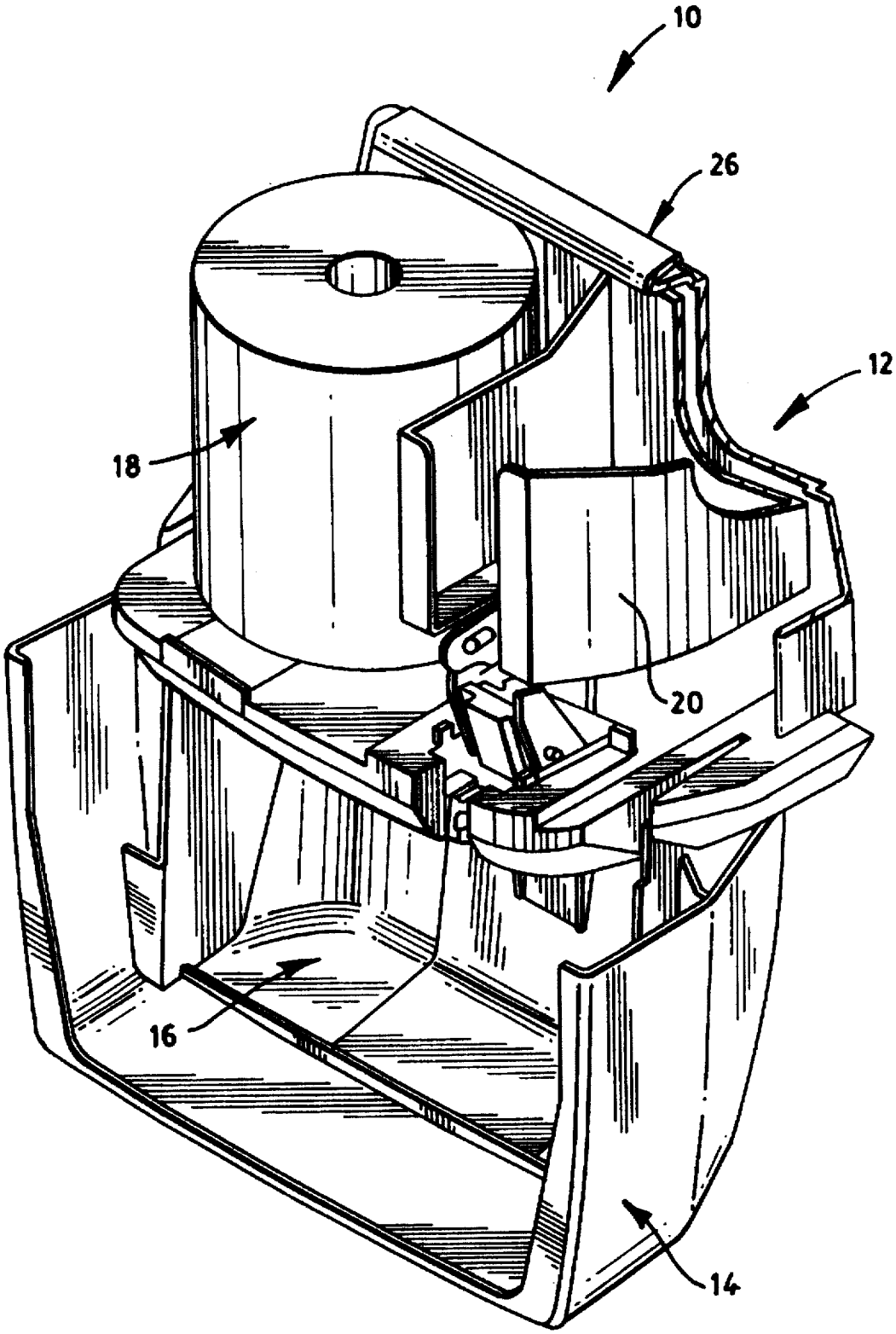
FIG. 2 is a perspective view of the system shown in FIG. 1, shown in an open position.
Figure 3:
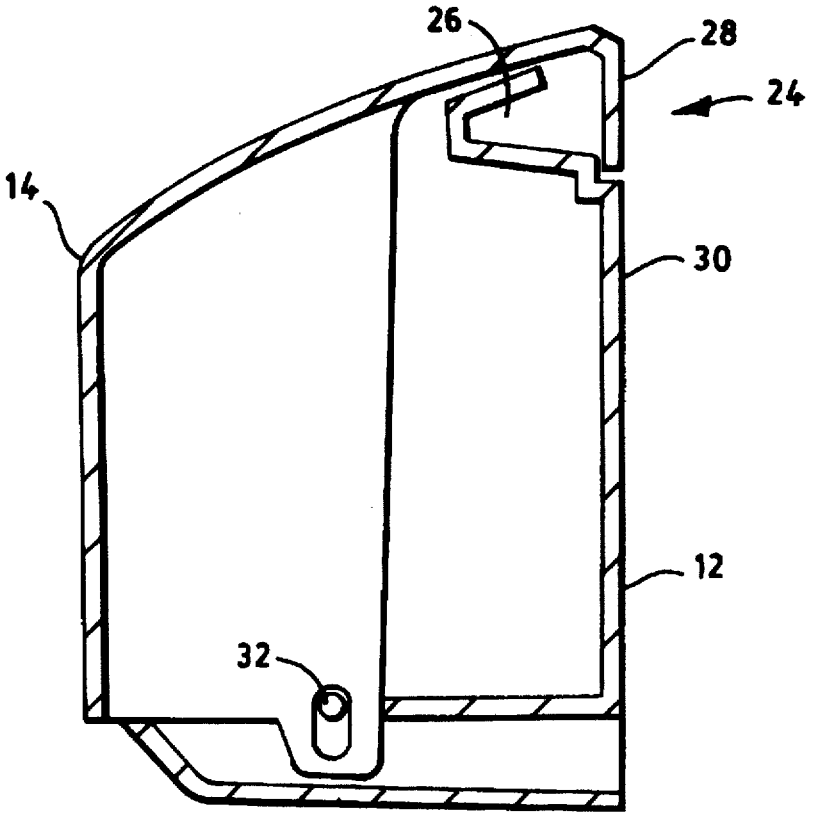
FIG. 3 is a cross sectional view of the system shown in FIG. 1, with parts omitted for clarity.

Referring now to the drawings, wherein like reference numerals designate corresponding structure throughout the views, and referring in particular to FIGS. 1 and 2 an improved system 10 for dispensing a hygienic product in a public washroom includes a base 12 that is adapted to be mounted to a surface in a public washroom, preferably a vertical surface, and a cover 14 that is pivotally mounted to base 12 by a pivot joint 32, which may be seen in FIG. 3.

Looking now to FIG. 2, it will be seen that cover 14 defines an interior space 16 in which is positioned a first dispensing mechanism 18 for an absorbent paper product, preferably paper towels. Also positioned in the interior space 16 that is defined by cover 14 is a dispenser 20 for liquid soap, which can be actuated by actuator handle 22 when the system 10 is in the closed, operative dispensing position that is illustrated in FIG. 1.

According to one particularly advantageous aspect of the invention, a water channeling structure 24 is positioned between the base 12 and the cover 14 to channel water that may fall between the cover 14 and the base 12 away from the interior base 16, so that the dispensing mechanism 18, 20 and any product therein would be prevented from getting wet during custodial cleaning. This is particularly advantageous for the mechanism dispensing paper towels 18, otherwise the paper towels would get wet.

As is best shown in FIG. 3, water channeling structure 24 preferably includes a gutter 26 that is defined in one of the cover 14 and the base 12, and a shield member 28 that is defined on the other of the cover 14 and the base 12. The shield member 28 is positioned above the gutter 26 is as to direct any water flowing thereon into the gutter 26, where it will flow around the sides of the system 10 and drip safely to the floor or other underlying surface. In the preferred embodiment that is shown in FIG. 3, gutter 26 is defined on an upper end 30 of the base 12, and shield member 28 is defined in an upper portion of cover 14. As may be seen in FIG. 3, the cover 14 is mounted so as to pivot about pivot point 32 with respect to base 12 when moving between the closed position shown in FIG. 1 and the open position shown in FIG. 2 so that the shield member 28 will move in an arc over the gutter 26 when moving between the opening and closed positions.

Figure 4:
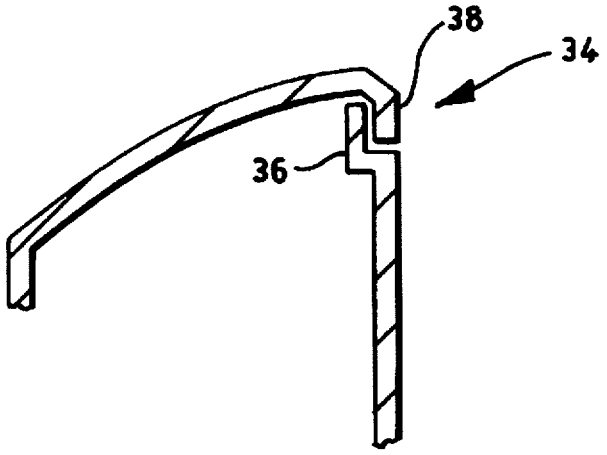
FIG. 4 is a cross sectional view of an alternative embodiment to those features of the system that are shown in FIG. 3.

Referring now to FIG. 4, a second embodiment 34 of the water channeling structure also includes a gutter 36 that is defined in the upper end 30 of base 12, and a shield member 38 that is an upper portion of the cover 14. In this embodiment, gutter 36 is relatively narrow, and is positioned directly next o the shield member 38 when the system 10 is in the closed operative position indicated in FIG. 1.

It is to be understood, however, that even though numerous characteristics and advantages of the present invention have been set forth in the foregoing description, together with details of the structure and function of the invention, the disclosure is illustrative only, and changes may be made in detail, especially in matters of shape, size and arrangement of parts within the principles of the invention to the full extent indicated by the broad general meaning of the terms in which the appended claims are expressed.

What is claimed is:

1. A system for dispensing a hygienic product in a public washroom, comprising:

a base that is adapted to be mounted to a surface in a public washroom;

a dispensing mechanism;

a cover that is mounted to said base, said cover defining an interior space in which said dispensing mechanism is positioned, said cover being mounted to said base so as to be movable between an open position for refilling said system with hygienic product and a closed, operative dispensing position; and water channeling means positioned between said base and said cover to channel water that may fall between said cover and said base away from said interior space, whereby said dispensing mechanism and any product therein will be prevented from getting wet during custodial cleaning.

2. A system according to claim 1, wherein said dispensing mechanism comprises a dispenser for absorbent paper.

3. A system according to claim 2, wherein said dispensing mechanism comprises a dispenser for paper towels.

4. A system according to claim 2, wherein said dispensing mechanism further comprises a dispenser for hand soap.

5. A system according to claim 1, wherein said water channeling means comprises a gutter defined in one of said cover and said base and a shield member defined on the other of said cover and said base, said shield member being positioned above said gutter so as to direct any water flowing thereon into said gutter, whereby water is prevented from flowing into said interior space.

6. A system according to claim 5, wherein said gutter is defined in said base and said shield is defined in said cover.

7. A system according to claim 6, wherein said cover is mounted so as to pivot with respect to said base, and said shield will move in an arc over said gutter when moving between said open and closed positions.

8. A system according to claim 6, wherein said base is mounted to a vertical surface and said gutter is defined in an upper end of said base.

9. A combined paper towel and hand soap dispenser for a public washroom, comprising:

a base that is adapted to be mounted to a surface in a public washroom;

a paper towel dispensing mechanism;

a hand soap dispensing mechanism;

an cover that is mounted to said base, said cover defining an interior space in which said paper towel dispensing mechanism and said hand soap dispensing mechanisms are positioned, said cover being mounted to said base so as to be movable between an open position for refilling said system with hygienic product and a closed, operative dispensing position; and water channeling means positioned between said base and said cover to channel water that may fall between said cover and said base away from said interior space, whereby said dispensing mechanisms and any product therein will be prevented from getting wet during custodial cleaning.

10. A system according to claim 9, wherein said water channeling means comprises a gutter defined in one of said cover and said base, and a shield member defined on the other of said cover and said base, said shield member being positioned above said gutter so as to direct any water flowing thereon into said gutter, whereby water is prevented from flowing into said interior space.

11. A system according to claim 10, wherein said gutter is defined in said base and said shield is defined in said cover.

12. A system according to claim 11, wherein said cover is mounted so as to pivot with respect to said base, and said shield will move in an arc over said gutter when moving between said open and closed positions.

13. A system according to claim 11, wherein said base is mounted to a vertical surface and said gutter is defined in an upper end of said base.

* * * * *